US012421061B2

(12) United States Patent
Onishi

(10) Patent No.: US 12,421,061 B2
(45) Date of Patent: Sep. 23, 2025

(54) SHEET FEEDING APPARATUS AND IMAGE FORMING APPARATUS THEREWITH

(71) Applicant: KYOCERA Document Solutions Inc., Osaka (JP)

(72) Inventor: Shota Onishi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 18/760,512

(22) Filed: Jul. 1, 2024

(65) Prior Publication Data

US 2025/0011110 A1 Jan. 9, 2025

(30) Foreign Application Priority Data

Jul. 6, 2023 (JP) ..... 2023-111361

(51) Int. Cl.
*B65H 1/14* (2006.01)
*B65H 1/26* (2006.01)

(52) U.S. Cl.
CPC ..... *B65H 1/14* (2013.01); *B65H 1/266* (2013.01); *B65H 2405/1117* (2013.01); *B65H 2405/114* (2013.01)

(58) Field of Classification Search
CPC . B65H 1/14; B65H 1/266; B65H 1/12; B65H 1/08; B65H 2405/114; B65H 2405/1117; G03G 15/6511
See application file for complete search history.

(56) References Cited

U.S. PATENT DOCUMENTS 11,396,437 B2 * 7/2022 Nitta ..... B65H 29/14

FOREIGN PATENT DOCUMENTS

JP 2017-030877 A 2/2017

* cited by examiner

*Primary Examiner* — Jeremy R Severson
(74) *Attorney, Agent, or Firm* — Stein IP, LLC

(57) ABSTRACT

A sheet feeding apparatus includes a sheet storage portion that stores sheets. The sheet storage portion has a bottom wall portion and a circumferential wall portion. The circumferential wall portion has a pair of support protruding portions and a groove portion. The pair of support protruding portions protrude from opposite inner circumferential faces facing each other along the axial direction of a pivot axis to be inserted in through holes, and pivotably support the sheet stacking plate. The groove portion is concave outward along the axial direction from the opposite inner circumferential faces facing each other along the axial direction of the pivot axis, and extends along the pivoting direction of the projection portion. With the sheet stacking plate raised, the projection portion is disposed in the groove.

6 Claims, 9 Drawing Sheets

SHEET FEEDING APPARATUS AND IMAGE FORMING APPARATUS THEREWITH

INCORPORATION BY REFERENCE

This application is based on and claims the benefit of priority from Japanese Patent Application No. 2023-111361 filed on Jul. 6, 2023, the contents of which are hereby incorporated by reference.

BACKGROUND

The present disclosure relates to a sheet feeding apparatus, and also relates to an image forming apparatus provided with a sheet feeding apparatus.

A known sheet feeding apparatus includes a sheet storage portion, a sheet stacking plate, and a lift mechanism. The sheet storage portion stores sheets. The sheet stacking plate is supported so as to be pivotable in the up-down direction about a pivot axis disposed in an upstream end part of it along the sheet conveying direction. The lift mechanism raises and lowers the sheet stacking plate. The topmost one of the sheets stacked on the sheet stacking plate is fed out sequentially.

With this known technology, if an impact from a fall or the like is applied during transport, the sheet stacking plate may drop off the sheet storage portion. This necessitates, at the time of unpacking, additional work of fitting the sheet stacking plate back to the sheet storage portion, adding to inconvenience. The sheet stacking plate may be fastened to the sheet storage portion with a packing material such as tape, but this necessitates, at the time of unpacking, additional work of removing the packing material, adding to inconvenience. The extra rubbish too adds to inconvenience.

Under the above background, an object of the present disclosure is to provide a sheet feeding apparatus that can be unpacked with improved convenience and with reduced rubbish, and to provide an image forming apparatus provided with such a sheet feeding apparatus.

SUMMARY

According to one aspect of the present disclosure, a sheet feeding apparatus includes a sheet storage portion that stores sheets, a sheet stacking plate, and a lift mechanism. The sheet stacking plate is supported so as to be pivotable in the up-down direction about a pivot axis disposed in an upstream end part of it along the sheet conveying direction. The lift mechanism raises and lowers the sheet stacking plate. The sheet storage portion has a bottom wall portion and a circumferential wall portion. On the bottom wall portion, the sheet stacking plate is placed. The circumferential wall portion protrudes upward from a circumferential edge part of the bottom wall portion to surround the bottom wall portion. The sheet stacking plate has a plate-form base portion, a supporting segment, and a projection portion. The base portion is disposed on the bottom wall portion and has the sheets stacked on it. The supporting segment protrudes upward from opposite end parts of the base portion along the axial direction, and has a through hole penetrating along the axial direction. The projection portion protrudes from an upper end part of the supporting segment outward along the axial direction. The circumferential wall portion has a pair of support protruding portions and a groove portion. The pair of support protruding portions protrude from opposite inner circumferential faces facing each other along the axial direction of the pivot axis to be inserted in the through holes, and pivotably support the sheet stacking plate. The groove portion is recessed outward along the axial direction from the opposite inner circumferential faces facing each other along the axial direction of the pivot axis, and extends along the pivoting direction of the projection portion. With the sheet stacking plate raised, the projection portion is disposed in the groove portion.

This and other objects of the present disclosure, and the specific benefits obtained according to the present disclosure, will become apparent from the description of embodiments which follows.

DETAILED DESCRIPTION

<Construction of an Image Forming Apparatus 100>

Figure 1:
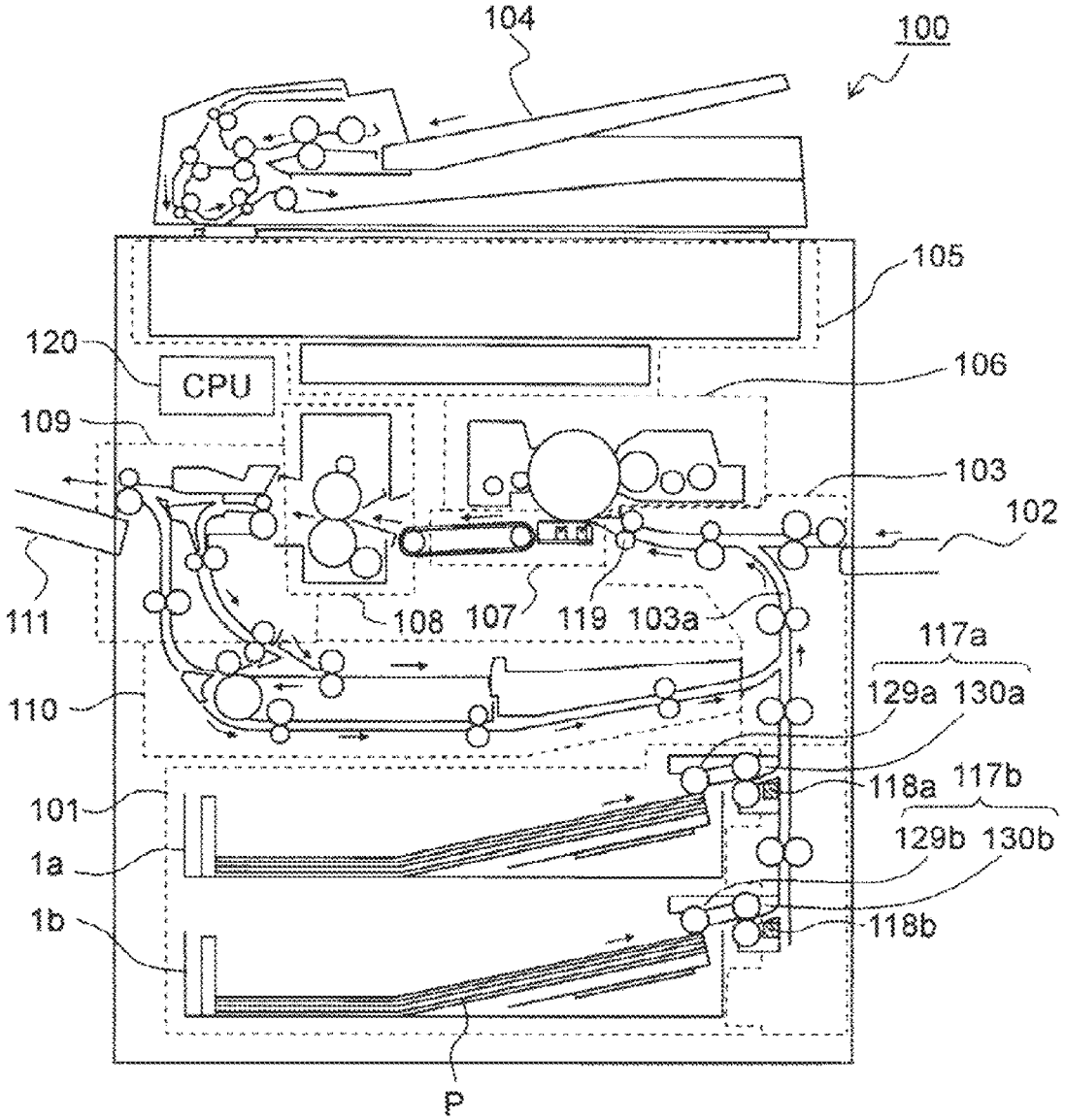
FIG. 1 is a sectional view showing the internal construction of an image forming apparatus 100 according to an embodiment of the present disclosure.

An embodiment of the present disclosure will be described below with reference to the accompanying drawings. FIG. 1 is a sectional view showing the internal construction of an image forming apparatus 100 according to an embodiment of the present disclosure. In the diagram, solid-line arrows indicate the path and the direction of the conveyance of sheets.

The image forming apparatus 100 includes a cassette loading portion 101, sheet feeding units 117*a* and 117*b*, a hand-feed tray 102, a sheet conveying portion 103, a document conveying device 104, an image reading portion 105, an image forming portion 106, a transfer portion 107, a fixing portion 108, a discharge-branch portion 109, a duplex printing unit 110, and a control portion 120.

The cassette loading portion 101 is disposed in a lower part of the image forming apparatus 100. The cassette loading portion 101 is fitted with two sheet feeding devices 1*a* and 1*b*. The sheet feeding devices 1*a* and 1*b* each store in it a bundle of unprinted sheets P of paper in a stacked form.

The sheet feeding units 117*a* and 117*b* each feed out one sheet P after another separately out of the bundle of sheets P. The sheet feeding unit 117*a* includes a pickup roller 129*a* and a pair of sheet feed rollers 130*a*, which are provided to correspond to the sheet feeding device 1*a*. The sheet feeding unit 117*b* includes a pickup roller 129*b* and a pair of sheet feed rollers 130*b*, which are provided to correspond to the sheet feeding device 1*b*.

The hand-feed tray 120 is provided on an upper part of the right side face of the image forming apparatus 100, outside it. On the hand-feed tray 120 are placed sheets of a size or thickness different from the sheets P in the sheet feeding devices 1*a* and 1*b*, or sheets that are fed in one by one, such as OHP sheets, envelopes, postcards, and invoices.

The sheet conveying portion 103 is located to the right of the cassette loading portion 101, that is, downstream of it along the sheet conveying direction, and to the left of the hand-feed tray 120, that is, downstream of it along the sheet conveying direction. A sheet P fed out from the sheet feeding devices 1*a* and 1*b* is conveyed by the sheet conveying portion 103 vertically upward along a side face of the body of the image forming apparatus 100; a sheet P fed out from the hand-feed tray 120 is conveyed horizontally.

The document conveying device 104 is disposed on the top face of the image forming apparatus 100, and the image reading portion 105 is disposed under the document conveying device 104. When a user wants to copy a document, he places a plurality of document sheets on the document conveying device 104. The document conveying device 104 feeds out the document sheets one by one separately, and the image reading portion 105 reads image data from them.

The image forming portion 106 and the transfer portion 107 are disposed downstream of the sheet conveying portion 103 along the sheet conveying direction, under the image reading portion 105. In the image forming portion 106, based on the image data read by the image reading portion 105, an electrostatic latent image of the document image is formed, and this electrostatic latent image is developed to form a toner image. On the other hand, in coordination with the timing of toner image formation in the image forming portion 106, a sheet P is conveyed from the sheet feeding device 1*a* or 1*b* via a pair of registration rollers 119 in the sheet conveying portion 103 to the transfer portion 107. The toner image formed in the image forming portion 106 is transferred to the sheet P in the transfer portion 107.

The fixing portion 108 is disposed downstream of the transfer portion 107. The sheet P having an unfixed toner image transferred to it in the transfer portion 107 is conveyed to the fixing portion 108. The fixing portion 108 has a nip portion between a pair of fixing rollers comprising a heating roller and a pressing roller. As the sheet P passes through the nip portion, the unfixed toner image is fixed to the sheet P.

The discharge-branch portion 109 is disposed downstream of the fixing portion 108, near the left side face of the image forming apparatus 100. The sheet P discharged from the fixing portion 108 is, if it is not subjected to duplex printing, discharged from the discharge-branch portion 109 onto a sheet discharge tray 111 provided on the left side face of the image forming apparatus 100, outside it.

The duplex printing unit 110 is disposed over the cassette loading portion 101. When duplex printing is performed, the sheet P discharged from the fixing portion 108 is fed via the discharge-branch portion 109 to the duplex printing unit 110. The sheet P fed to the duplex printing unit 110 is switched back to be reversed obverse side down, and is then, with the side having no image formed on it yet facing up, conveyed once again via the sheet conveying portion 103 to the transfer portion 107.

The control portion 120 controls the driving of different parts of the image forming apparatus 100, such as the cassette loading portion 101, the sheet conveying portion 103, the image reading portion 105, the image forming portion 106, the transfer portion 107, and the fixing portion 108.

<Structure of the Sheet Feeding Device 1*a*>

Figure 2:
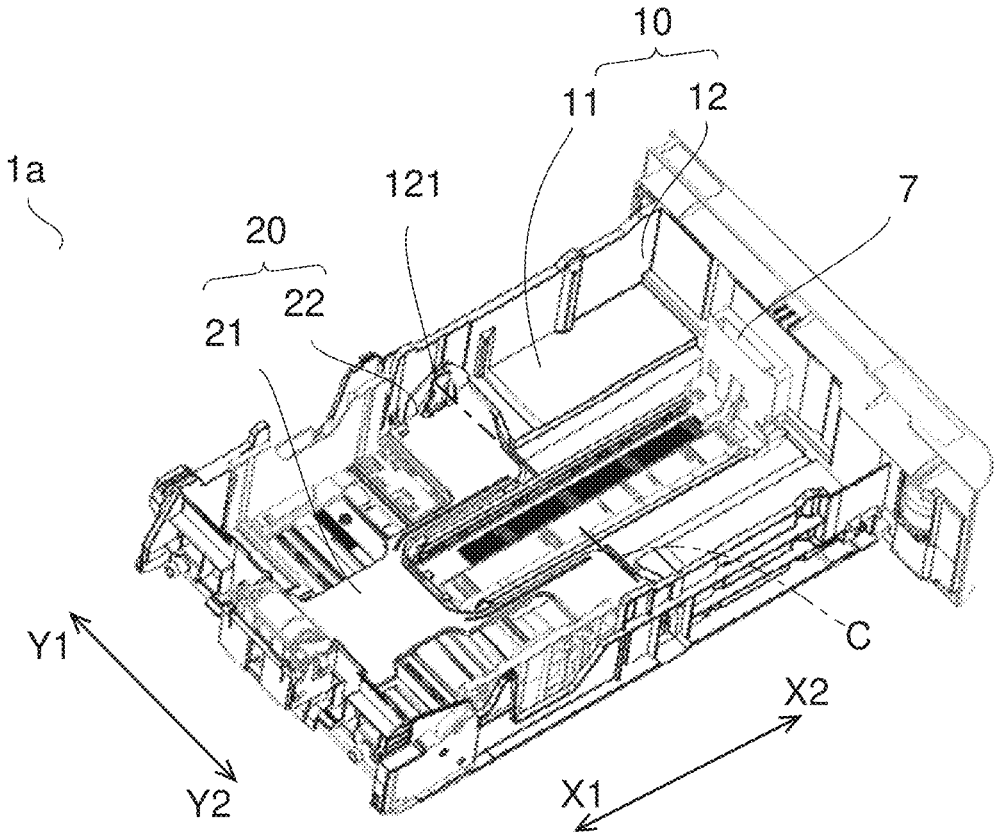
FIG. 2 is a perspective view of a sheet feeding device 1*a* in the image forming apparatus 100 according to the embodiment of the present disclosure.
Figure 3:
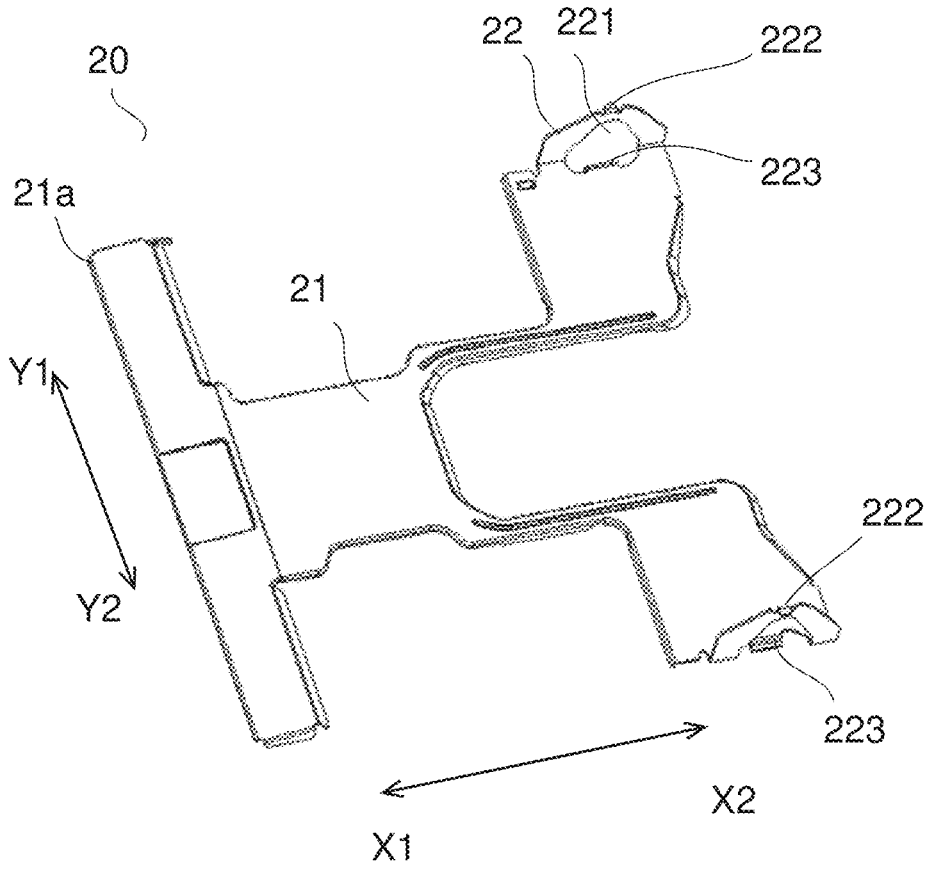
FIG. 3 is a perspective view of a sheet stacking plate 20 in the image forming apparatus 100 according to the embodiment of the present disclosure.
Figure 4:
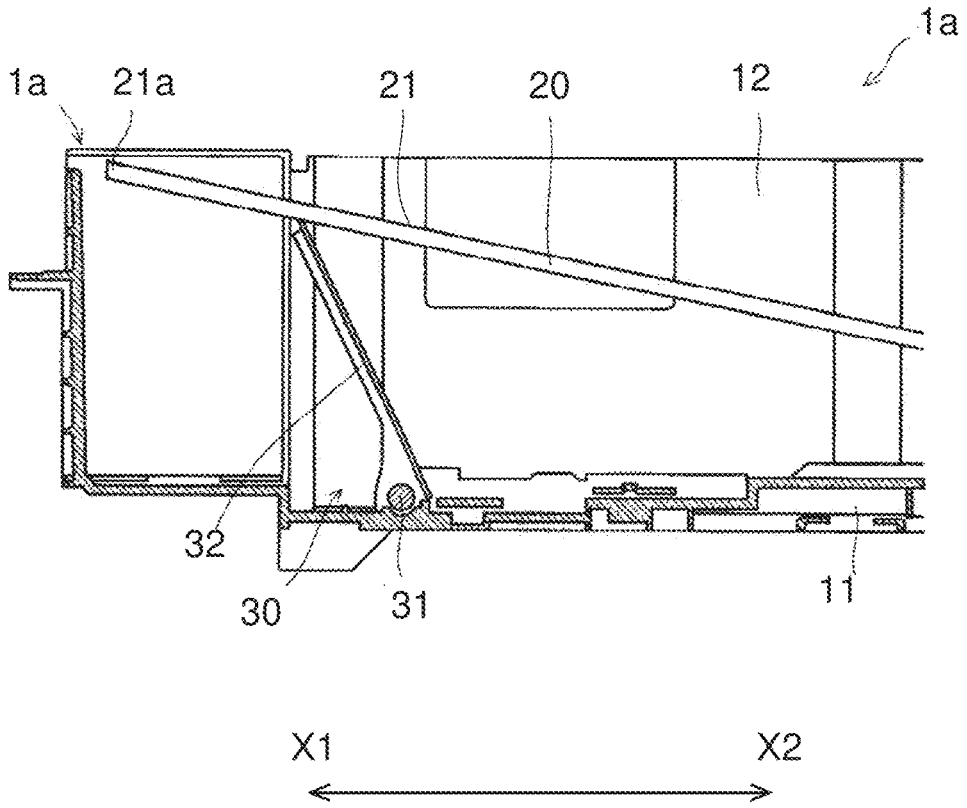
FIG. 4 is a side sectional view showing the structure around a lift mechanism 30 in the image forming apparatus 100 according to the embodiment of the present disclosure.

FIG. 2 is a perspective view of the sheet feeding device 1*a*, and FIG. 3 is a perspective view of a sheet stacking plate 20. FIG. 4 is a side sectional view showing the structure around a lift mechanism 30 for the sheet stacking plate 20 in the sheet feeding device 1*a*. While the following description deals with the structure of the sheet feeding device 1*a*, the sheet feeding device 1*b* has quite a similar structure.

In the diagrams, the insertion direction and the extraction direction of the sheet feeding device 1*a* with respect to the cassette loading portion 101 are indicated by arrows X1 and X2 respectively. The sheet conveying direction in the sheet feeding device 1*a* coincides with the insertion direction X1 of the sheet feeding device 1*a*. The axial direction (Y1-Y2) of a pivot axis C coincides with the width direction of the sheet P and the front-rear direction of the image forming apparatus 100. In this embodiment, the sheet conveying direction (X1-X2 direction), the axial direction (Y1-Y2 direction), and the up-down direction (Z1-Z2 direction) are orthogonal to each other.

The sheet feeding device 1*a* is mounted in the cassette loading portion 101. Above the sheet feeding device 1*a*, the sheet feeding unit 117*a* (see FIG. 1) is disposed, which feeds the sheet P (see FIG. 1) in the X1 direction. The sheet feeding device 1*a* includes a sheet storage portion 10, a sheet stacking plate 20, a cursor 7, and a lift mechanism 30.

The sheet storage portion 10 is in the shape of a box open at the top. The sheet storage portion 10 stores sheets P in it in a stacked form. The sheet storage portion 10 has a bottom wall portion 11 and a circumferential wall portion 12. The bottom wall portion 11 is formed in a rectangular shape as seen in a top view.

The circumferential wall portion 12 is formed so as to protrude upward Z1 from a circumferential edge part of the bottom wall portion 11 in an annular shape. On the inner circumferential faces of the circumferential wall portion 12 facing each other along the axial direction (Y1-Y2 direction) of the pivot axis C, a pair of support protruding portions 121 are formed. The support protruding portions 121 are formed to protrude along the axial direction (Y1-Y2 direction) from those inner circumferential faces of the circumferential wall portion 12.

The sheet stacking plate 20 is supported so as to be pivotable in the up-down direction about a pivot axis C disposed in an upstream X2 end part of it along the sheet conveying direction. The sheet stacking plate 20 has a base portion 21 and supporting segments 22. The base portion 21 is a plate-form member on which sheets P are stacked, and is disposed on the bottom wall portion 11. The supporting segments 22, a pair of them, are disposed in an upstream X2 end part of the base portion 21 along the sheet conveying direction, one at each of opposite end parts of it along the axial direction (Y1-Y2 direction).

The supporting segment 22 is formed in the shape of a plate protruding upward Z1 from the top face of the base portion 21. The supporting segment 22 is disposed along a direction orthogonal to the axial direction (Y1-Y2 direction), parallel to the circumferential wall portion 12. Each supporting segment 22 has a through hole 221 penetrating it along the axial direction (Y1-Y2 direction). A lower end part of the through hole 221 extends into the base portion 21. Accordingly, the inner end of the through hole 221 along the axial direction (Y1-Y2 direction) is located inward, along the axial direction (Y1-Y2 direction), of the inner end of the supporting segment 22 along the axial direction (Y1-Y2 direction). Into the through hole 221, the support protruding portion 121 is inserted. Thus, a downstream (X1 direction) end part of the sheet stacking plate 20 along the sheet conveying direction is supported by the support protruding portions 121.

The sheet stacking plate 20 is arranged such that its swinging end 21*a* (the downstream X1 end along the sheet conveying direction) is ascendable and descendable relative to the sheet storage portion 10 about the upper end edge of the through hole 221 in contact with the support protruding portion 121. The fitting structure between the sheet storage portion 10 and the sheet stacking plate 20 will be described in detail later.

The cursor 7 is disposed upstream X2 of the sheet stacking plate 20 along the sheet conveying direction. The cursor 7 is movable to and fro along the sheet conveying direction (X1-X2 direction) on the bottom wall portion 11. The cursor 7 sets the position, along the sheet conveying direction (X1-X2 direction), of the ends of the sheets P stacked on the sheet stacking plate 20.

The lift mechanism 30 is disposed below a part of the sheet stacking plate 20 near its swinging end 21*a*. The lift mechanism 30 has a swing shaft 31 and an actuating plate 32. The swing shaft 31 extends along the sheet width direction (Y1-Y2 direction), and opposite end parts of the swing shaft 31 are rotatably supported respectively on two bearing portions (unillustrated) formed on the bottom wall portion 11 of the sheet storage portion 10. An end part of the swing shaft 31 along the axial direction is connected to a lift driving portion (unillustrated).

A base end part of the actuating plate 32 is fixed to the swing shaft 31. The actuating plate 32 is disposed, for example, at a position facing a substantially middle part of the reverse face of the sheet stacking plate 20 along the axial direction (Y1-Y2 direction) direction.

As the lift driving portion (unillustrated) rotates the swing shaft 31, the actuating plate 32 rotates together. Thus, the sheet stacking plate 20 ascends and descends between a raised position, where sheets P are fed out, and a lowered position, where sheets (replenishment sheets) P can be set.

<Fitting Structure Between the Sheet Storage Portion 10 and the Sheet Stacking Plate 20>

Figure 5:
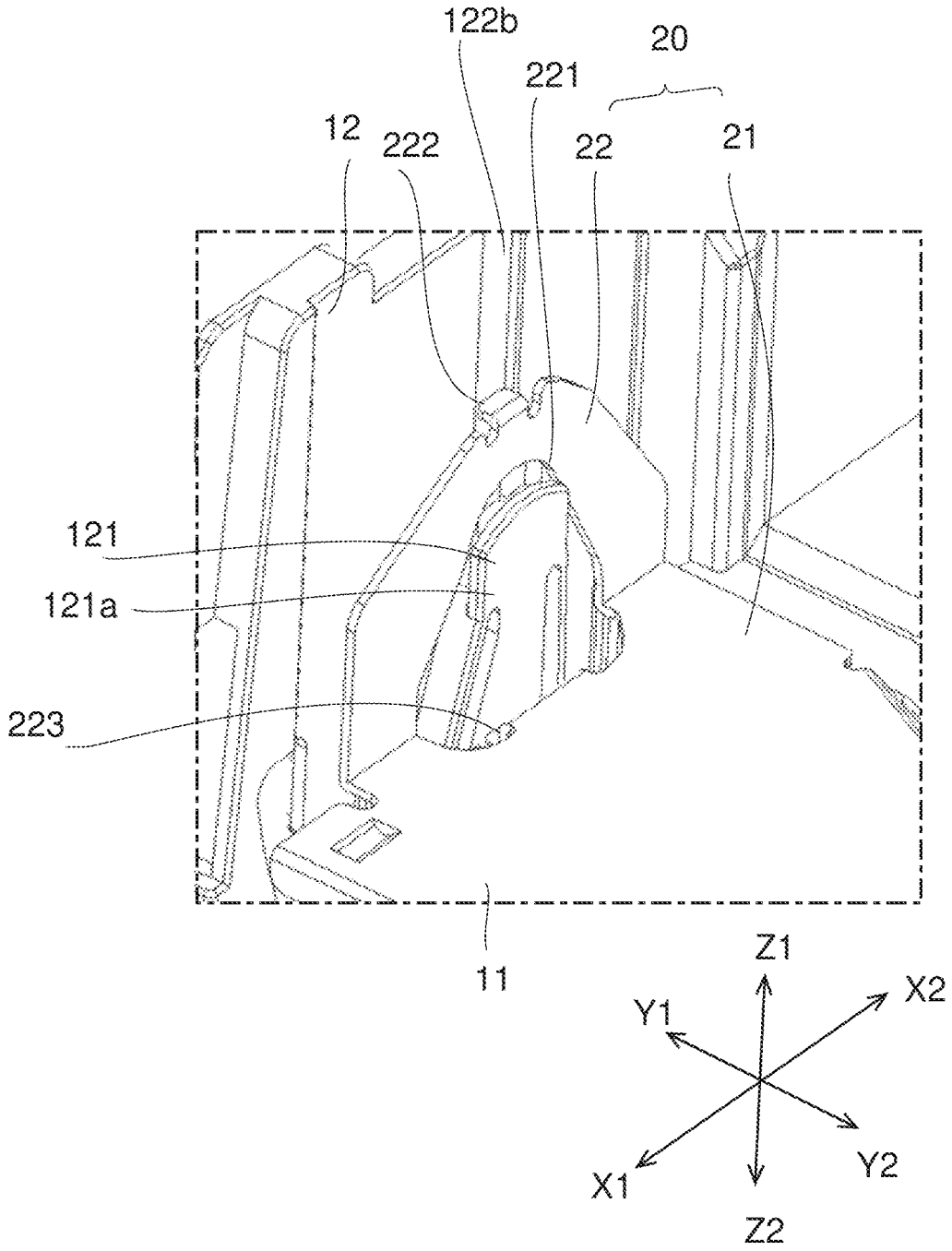
FIG. 5 is a perspective view showing, on an enlarged scale, an area around a supporting segment 22 of the sheet stacking plate 20 in the image forming apparatus 100 according to the embodiment of the present disclosure.
Figure 6:
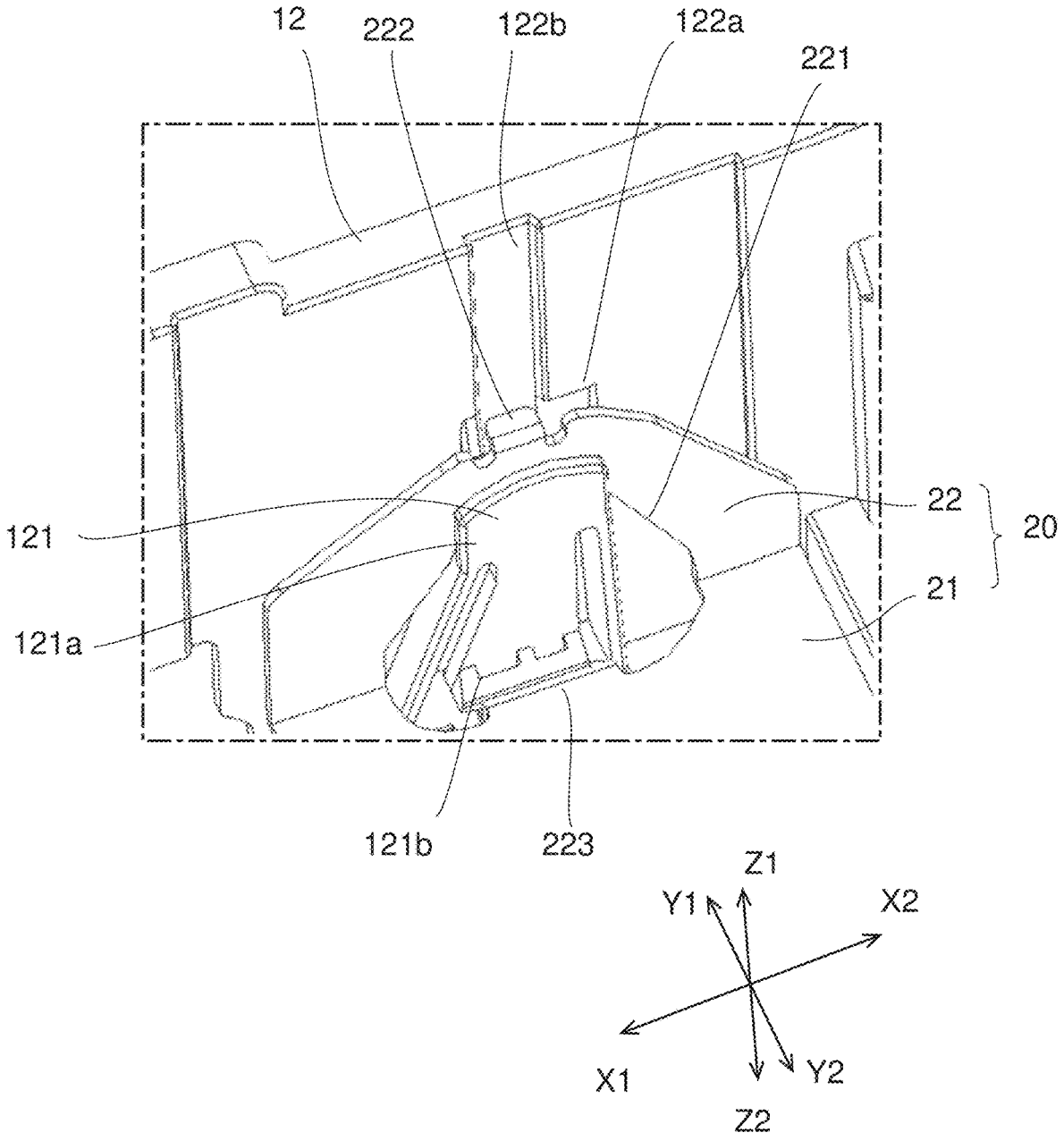
FIG. 6 is a perspective view showing, on an enlarged scale, an area around the supporting segment 22 of the sheet stacking plate 20 in the image forming apparatus 100 according to the embodiment of the present disclosure.
Figure 7:
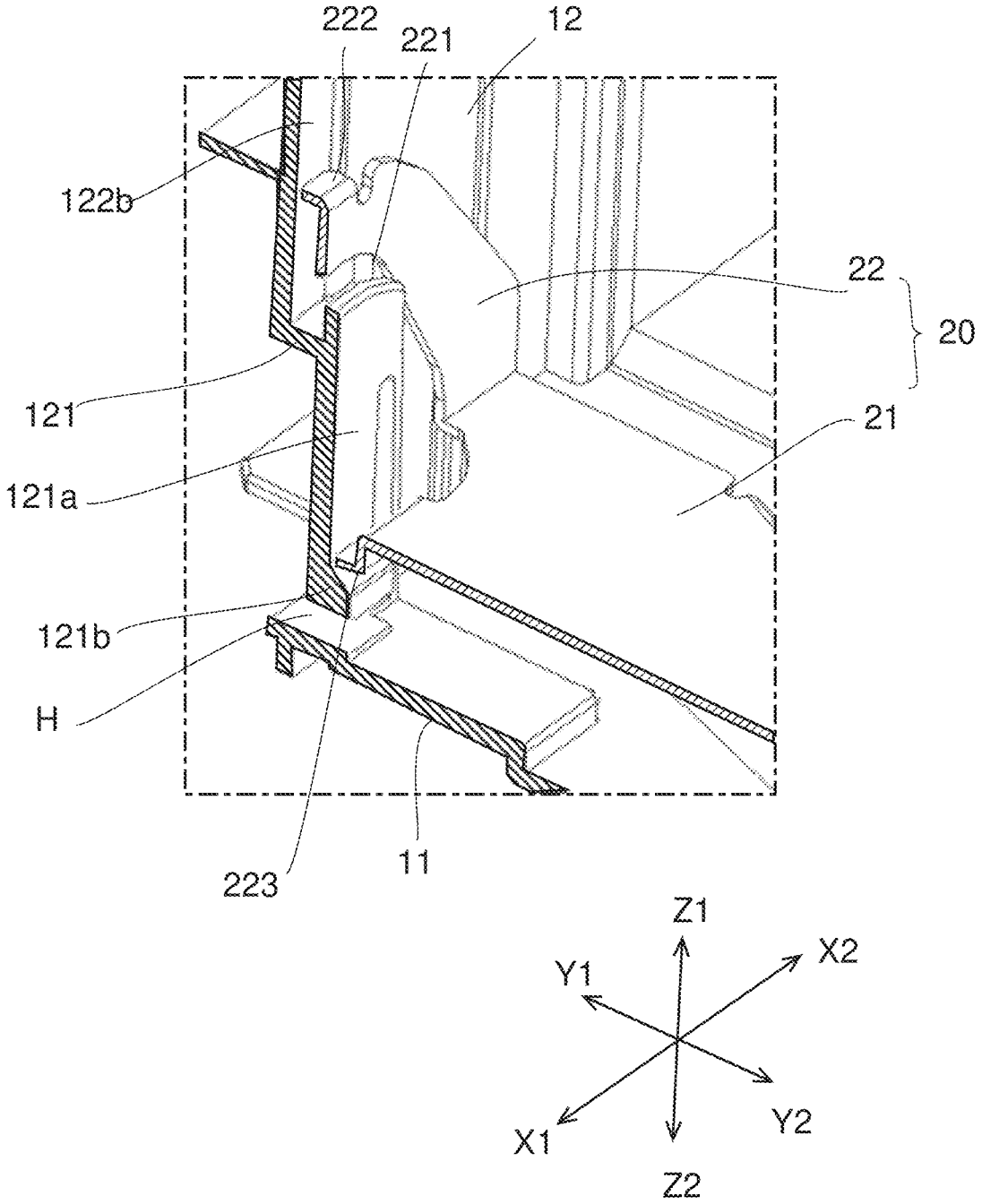
FIG. 7 is a vertical sectional view showing, on an enlarged scale, an area around the supporting segment 22 of the sheet stacking plate 20 in the image forming apparatus 100 according to the embodiment of the present disclosure.
Figure 8:
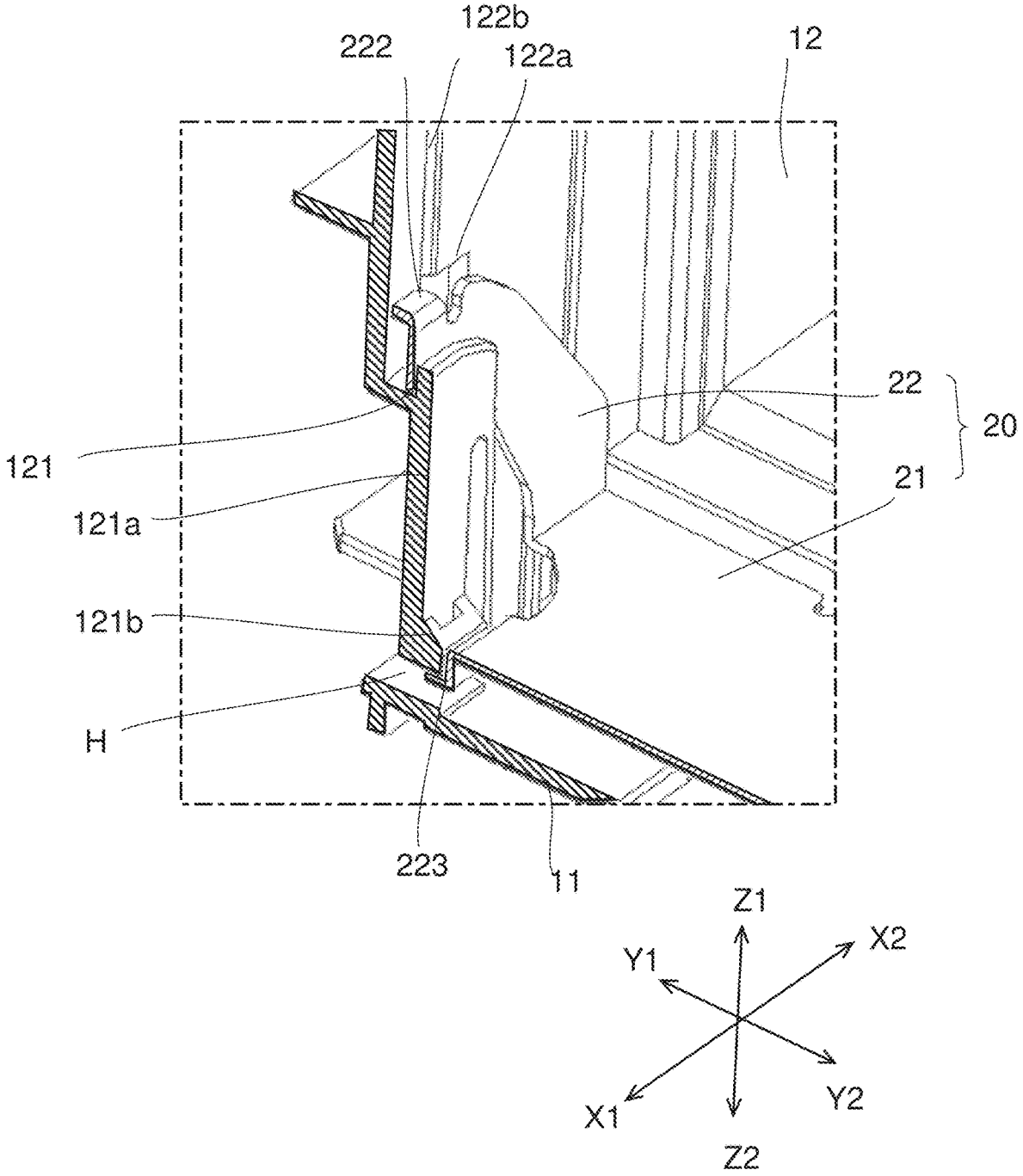
FIG. 8 is a vertical sectional view showing, on an enlarged scale, an area around the supporting segment 22 of the sheet stacking plate 20 in the image forming apparatus 100 according to the embodiment of the present disclosure.

FIGS. 5 and 6 are perspective views showing, on an enlarged scale, an area around the supporting segment 22 of the sheet stacking plate 20, FIG. 5 showing a state before the sheet stacking plate 20 is fitted to the sheet storage portion 10 and FIG. 6 showing a state after the sheet stacking plate 20 is fitted to the sheet storage portion 10. FIGS. 7 and 8 are vertical sectional views showing, on an enlarged scale, an area around the supporting segment 22 of the sheet stacking plate 20, FIG. 7 showing a state before the sheet stacking plate 20 is fitted to the sheet storage portion 10 and FIG. 8 showing a state after the sheet stacking plate 20 is fitted to the sheet storage portion 10.

The sheet stacking plate 20 has a projection portion 222 and a convex portion 223. The projection portion 222 protrudes from an upper end part of the supporting segment 22 outward along the axial direction (Y1-Y2 direction).

The convex portion 223 protrudes from the circumference of the lower end of a through hole 221 outward along the axial direction (Y1-Y2 direction). More specifically, the convex portion 223 extends downward from the circumference of the lower end of the through hole 221, and a tip end part of it bends outward along the axial direction (Y1-Y2 direction). This permits the convex portion 223 to deform easily, and helps absorb the stress acting on the supporting segment 22 and prevent its breakage.

The support protruding portion 121 has a lock portion 121*a* and a rib 121*b*. The lock portion 121*a* is formed in the shape of a plate extending along the up-down direction from a tip end part of the support protruding portion 121 along the axial direction (Y1-Y2 direction). The lock portion 121*a* is disposed parallel to the supporting segment 22. The lower end of the lock portion 121*a* is located above the top face of the bottom wall portion 11, and between the lock portion 121*a* and the bottom wall portion 11, a gap H is formed (see FIGS. 7 and 8).

The rib 121*b* protrudes from a lower end part of the lock portion 121*a* inward along the axial direction (Y1-Y2 direction) and extends along the sheet conveying direction (A1-A2 direction). The top face of the rib 121*b* is inclined downward from a lower end part of it inward along the axial direction (Y1-Y2 direction). Thus, the convex portion 223 is guided smoothly downward Z2 by sliding on the top face of the rib 121*b*.

The circumferential wall portion 12 has groove portions 122*a* and 122*b*. The groove portions 122*a* and 122*b* are formed to be concave outward along the axial direction (Y1-Y2 direction) from the inner circumferential faces of the circumferential wall portion 12 facing each other along the axial direction (Y1-Y2 direction). The groove portion 122*b* extends upward Z1 from a base part of the support protruding portion 121 and is open at the upper end. The groove portion 122*a* extends in the pivoting direction (X1-X2) of the projection portion 222. In this embodiment, the groove portion 122*a* extends from a lower end part of the groove portion 122*b* in the pivoting direction (X1-X2) of the projection portion 222. That is, the groove portion 122*a* branches off the groove portion 122*b* in a base part of the support protruding portion 121 and extends upward Z1.

When the sheet stacking plate 20 is fitted to the sheet storage portion 10, the projection portion 222 is placed above the groove portion 122*b* and the sheet stacking plate 20 is pushed in downward Z2. Thus, the projection portion 222 is guided along the groove portion 122*b* and the supporting segment 22 moves smoothly toward the support protruding portion 121 (see FIGS. 5 and 7).

When the sheet stacking plate 20 is pushed in further downward Z2, the convex portion 223 slides on the top face of the rib 121*b*. Here, the lock portion 121*a* and the convex portion 223 deform. When the rib 121*b* is inserted in the gap H, the lock portion 121*a* and the convex portion 223, which have been deformed, restore their original shapes. A upper end part of the through hole 221 is supported on the support protruding portion 121. Thus, the sheet stacking plate 20 is fitted to the sheet storage portion 10, and is supported on the support protruding portion 121 so as to be rotatable about the pivot axis C. When the sheet stacking plate 20 ascends and descends, the convex portion 223 moves along the sheet conveying direction (X1-X2 direction).

With the sheet stacking plate 20 fitted to the sheet storage portion 10, the convex portion 223 is covered from upward Z1 by the rib 121*b*. Thus, if the sheet stacking plate 20 is acted on by a force pointing upward Z1, for example, from an impact during transport, the convex portion 223 makes contact with the rib 121*b*. This prevents the sheet stacking plate 20 from dropping off the sheet storage portion 10. There is therefore no need to fasten the sheet stacking plate 20 to the sheet storage portion 10 with a packing material such as tape. It is thus possible to provide a sheet feeding device 1*a* that can be unpacked with improved convenience and with reduced rubbish.

Figure 9:
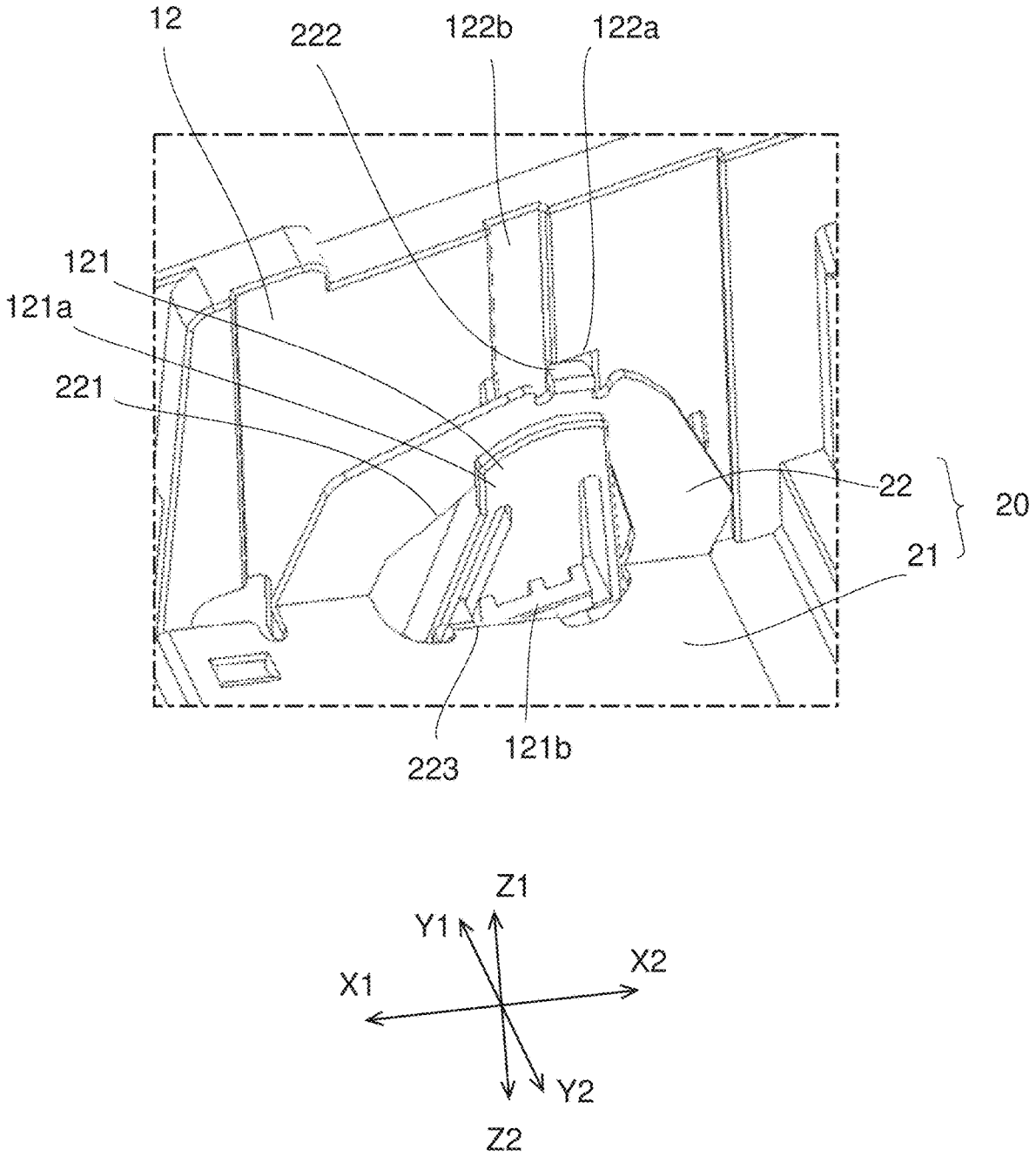
FIG. 9 is a perspective view showing, on an enlarged scale, an area around the supporting segment 22 of the sheet stacking plate 20 in the image forming apparatus 100 according to the embodiment of the present disclosure.

FIG. 9 is a perspective view showing, on an enlarged scale, an area around the supporting segment 22 of the sheet stacking plate 20, showing a state where the sheet stacking plate 20 fitted to the sheet storage portion 10 is raised. As the sheet stacking plate 20 ascends, the projection portion 222 rotates about the pivot axis C and moves upstream X2 along the sheet conveying direction to be inserted into the groove portion 122*a*. On the other hand, the convex portion 223 rotates about the pivot axis C and moves downstream X1 along the sheet conveying direction. Meanwhile, the convex portion 223 is displaced downstream X1 along the sheet conveying direction relative to the rib 121*b*.

Thus, if the sheet stacking plate 20 in a raised state is acted on by a force pointing upward Z1, the convex portion 223 may come off the rib 121*b*. In this embodiment, with the sheet stacking plate 20 raised, the projection portion 222 is disposed in the groove portion 122*a*. This more reliably prevents the sheet stacking plate 20 from dropping off the sheet storage portion 10.

The embodiment disclosed herein should be understood to be in every aspect illustrative and not restrictive. The scope of the present disclosure is defined not by the description of the embodiment given above but by the appended claims and encompasses any modifications made within a scope equivalent in significance to those claims.

For example, while the embodiment described above deals with an example where the lift mechanism makes the sheet stacking plate 20 ascend and descend by rotating the actuating plate 32, this may be achieved by any other mechanism. For example, a spiral spring can be used so that its urging force makes the sheet stacking plate 20 ascend and descend. While the embodiment described above deals with an example with two sheet feeding devices 1*a* and 1*b*, there may be provided one sheet feeding device, or three or more sheet feeding device.

What is claimed is:

1. A sheet feeding apparatus comprising:

a sheet storage portion that stores a sheet;

a sheet stacking plate that is supported so as to be pivotable in an up-down direction about a pivot axis disposed in an upstream end part thereof along a sheet conveying direction; and a lift mechanism that raises and lowers the sheet stacking plate, wherein the sheet storage portion has:

a bottom wall portion on which the sheet stacking plate is placed; and a circumferential wall portion protruding upward from a circumferential edge part of the bottom wall portion to surround the bottom wall portion, the sheet stacking plate has:

a plate-form base portion that is disposed on the bottom wall portion and on which the sheet is stacked;

a supporting segment that protrudes upward from opposite end parts of the base portion along an axial direction, the supporting segment having a through hole penetrating it along the axial direction; and a projection portion that protrudes from an upper end part of the supporting segment outward along the axial direction, the circumferential wall portion has:

a pair of support protruding portions that protrude from opposite inner circumferential faces facing each other along an axial direction of the pivot axis to be inserted in the through hole and that pivotably support the sheet stacking plate; and a groove portion that is recessed outward along the axial direction from the opposite inner circumferential faces facing each other along the axial direction of the pivot axis and that extends along a pivoting direction of the projection portion, and with the sheet stacking plate raised, the projection portion is disposed in the groove portion.

2. The sheet feeding apparatus according to claim 1, wherein the support protruding portion has:

a lock portion extending from a tip end part thereof along an up-down direction; and a rib protruding from a lower end part of the lock portion inward along the axial direction, the sheet stacking plate has a convex portion protruding from a circumference of a lower end of the through hole outward along the axial direction, and the convex portion is disposed in a gap along the up-down direction between the rib and the bottom wall portion.

3. The sheet feeding apparatus according to claim 2, wherein a top face of the rib is inclined downward as it goes inward along the axial direction.

4. The sheet feeding apparatus according to claim 3, wherein the convex portion extends downward from the circumference of the lower end of the through hole, and a tip end part of the convex portion is bent outward along the axial direction.

5. The sheet feeding apparatus according to claim 1, wherein the groove portion branches off the support protruding portion at a based part thereof to extend upward.

6. An image forming apparatus comprising:

the sheet feeding apparatus according to claim 1; and an image forming portion that forms an image on a sheet.

* * * * *